US008025147B2

(12) United States Patent
Smeenge

(10) Patent No.: US 8,025,147 B2
(45) Date of Patent: Sep. 27, 2011

(54) GOLF BALL STACKING DEVICE

(75) Inventor: Paul Smeenge, Grand Rapids, MI (US)

(73) Assignee: Visual Golf Solutions, Grand Rapids, MI (US)

( * ) Notice: Subject to any disclaimer, the term of this patent is extended or adjusted under 35 U.S.C. 154(b) by 176 days.

(21) Appl. No.: 12/432,326

(22) Filed: Apr. 29, 2009

(65) Prior Publication Data

US 2010/0278624 A1 Nov. 4, 2010

(51) Int. Cl.
*B65D 85/00* (2006.01)

(52) U.S. Cl. ..... 206/315.9; 206/499; 224/919

(58) Field of Classification Search ..... 206/315.9, 206/449; 53/235, 242, 244, 24.8, 147, 539, 53/541; 224/919
See application file for complete search history.

(56) References Cited

U.S. PATENT DOCUMENTS 1,778,225 A * 10/1930 Morss ..... 206/315.9
2,083,973 A * 6/1937 Zimmerman ..... 248/459
4,491,242 A * 1/1985 Trinidad ..... 221/312 R
5,183,153 A * 2/1993 Linn ..... 206/232
5,467,574 A * 11/1995 Thomsen ..... 53/397
5,695,312 A * 12/1997 Kelly ..... 414/788
5,882,173 A 3/1999 Ziegler
6,021,896 A * 2/2000 Marshall ..... 206/315.9
6,742,982 B2 * 6/2004 Kelly ..... 414/791.5
7,398,888 B1 * 7/2008 Nowak ..... 211/59.2
2006/0016947 A1 * 1/2006 Capozzi et al. ..... 248/284.1

OTHER PUBLICATIONS

Jack Thomsen Golf Enterprises. Home of the "Orignal" Stacker. [online] archive date of Jun. 3, 2002 [retrieved on Dec. 9, 2010] Retrieved from the internet, http://jtgolf.com/tray_stackers.htm.*

* cited by examiner

*Primary Examiner* — J. Gregory Pickett
*Assistant Examiner* — Blaine Neway
(74) *Attorney, Agent, or Firm* — Waters & Associates; John A. Waters

(57) ABSTRACT

A golf ball stacking device comprises a hollow, elongated body formed of three panels of clear, flexible plastic sheet material connected together at ends to form a hollow tube having an hourglass shape and a generally triangular cross section. Each panel has relatively wide upper and lower ends and a relatively narrow neck portion positioned between the ends. The neck portions are bowed inwardly to form a relatively narrow arcuate throat for balls to pass between larger upper and lower chambers of the body. The upper chamber comprises an inlet for receiving golf balls. The lower chamber comprises a stacking chamber for stacking the golf balls in a triangular pyramid. The panels are not rigidly connected together at the throat, so that the panels surrounding the throat can flex outwardly to prevent ball clogging in the throat. Slots in the side edges permit manipulation of the balls inside the device. A removable flat tray fits under the body and supports a triangular pyramidal stack of balls on the tray.

19 Claims, 9 Drawing Sheets

GOLF BALL STACKING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO A SEQUENCE LISTING

Not Applicable.

BACKGROUND OF THE INVENTION

The present invention relates to a device for stacking golf balls or other balls on a triangular ball support tray in the configuration of a pyramid having a triangular base for use in practice situations.

In golf practice areas, such as a driving range, it is customary to provide a golfer with a supply of practice golf balls in a wire basket or the like. The golfer either takes the balls out of the basket one at a time or tips the basket over and dumps the balls on the ground.

As an alternative to providing balls in buckets, in some applications, balls are stacked at individual practice sites in pyramid configurations using hollow pyramid forms to collect the balls. Examples of such devices are shown in Kelly U.S. Pat. No. 5,695,312, Ziegler U.S. Pat. No. 5,882,173, and Kelly U.S. Pat. No. 6,742,982.

In most golf ball stacking devices, the balls are stacked in the shape of a rectangular pyramid (i.e., a pyramid having a rectangular base) and are placed on dimpled or ridged trays that support the balls. A rectangular pyramid shape, however, provides a less than optimum configuration for stacking round balls together. In rectangular pyramid stacking devices, it is necessary to use a ball supporting tray that has ridges or dimples at spaced locations in order to properly position the balls. Trays having dimples or ridges are more expensive to manufacture than flat trays.

Another concern with some ball stacking devices is that balls may tend to clog in the relatively narrow throat between the inlet funnel at the top of the stacking device and the stack forming shell in the lower portion of the stacking device. Such clogs can be difficult to clear without dumping all of the balls out of the stacking device and starting over and pouring the balls in more slowly. Also, some stacking devices have a throat so large that the stacking of the last balls needs to be done manually, since the throat line is at the second row of balls.

An object of the present invention is to provide an improved golf ball stacking device that reduces clogging, permits visual observation of stacking inside the device, provides internal access for adjusting ball positions, and provides a triangular base shape that does not require dimples or ridges to position balls, thereby reducing the cost of manufacture.

SUMMARY OF THE INVENTION

In accordance with the present invention, a golf ball stacking device comprises a hollow, elongated body formed of three panels of resilient, flexible sheet material connected together at ends to form a hollow housing having a generally triangular cross section. Each panel has relatively wide upper and lower ends and a relatively narrow neck portion positioned between the ends. The neck portions of the panels are formed so that they extend inwardly in an arcuate shape such that the housing has a relatively narrow throat for balls to pass between relatively wide upper and lower chambers of the body. The upper chamber comprises an inlet for receiving golf balls. The lower chamber comprises a stacking chamber for forming the golf balls into a triangular pyramid. A removable flat tray with formed edges having a triangular shape fits under the lower end of the body and supports a triangular pyramidal stack of balls on the tray. The panels are connected together at top and bottom ends but are not rigidly connected together at the throat, so that the panels surrounding the throat can flex outwardly to provide a flexibly enlargeable throat opening for preventing ball clogging in the throat. The panels are desirably formed of a transparent sheet plastic material in order to be able to view and adjust ball position inside of the device. However, the sheet material could be non-transparent and could be formed of metal or other flexible material.

These and other features of the present invention will hereinafter appear, and for purposes of illustration but not of limitation a preferred embodiment of the present invention is described below and shown in the appended drawings.

DETAILED DESCRIPTION OF PREFERRED EMBODIMENT

Figure 1:
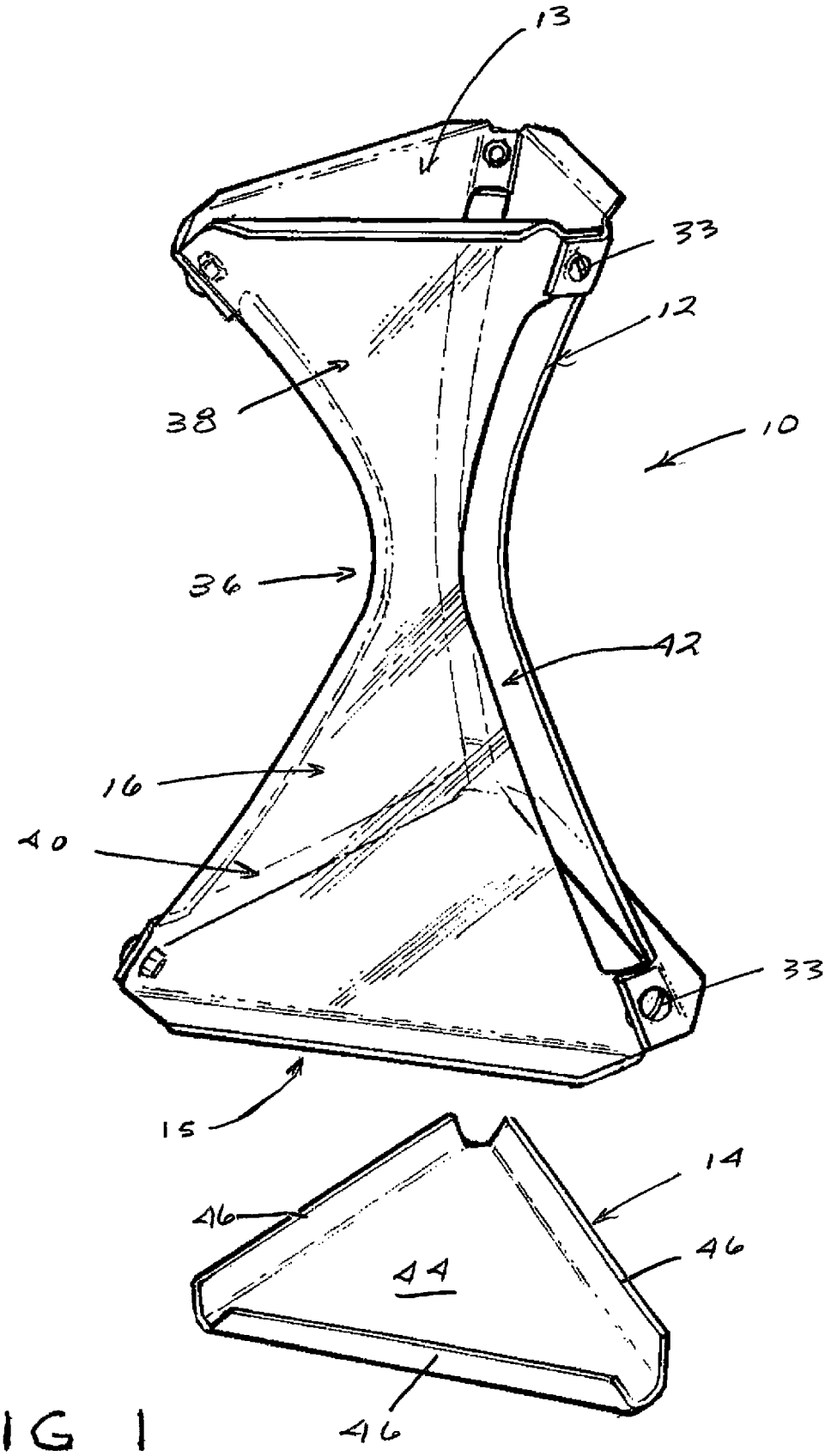
FIG. 1 is an exploded perspective view of the golf ball stacking device of the present invention, showing the golf ball stacking device separated from the ball stacking tray.

Referring now to the drawings, a ball stacking device 10 in accordance with the present invention comprises a hollow elongated body 12 that fits over a ball stacking tray 14. Body 12 comprises an hour glass shaped exterior shell having a triangular cross section and having an open top 13 and open bottom 15, which are of the same size in the preferred embodiment. Body 12 desirably is formed of three side panels 16 formed of a plastic or synthetic resin material such as polyethylene, a polyester known as "PETG", or the like. The side panels should be sufficiently stiff to hold their shape but flexible enough to flex to eliminate ball clogs, as described below. The panels desirably are about 2/32-3/16 inch thick and preferably about 3/32 or 4/32 of an inch thick. If a stiffer synthetic resin is employed, the panels can be thinner. However, the panels should not be so stiff that they are easily breakable. Desirably, the panels are substantially transparent, so that balls can be observed inside the ball stacking device. However, non-transparent panels and panels formed of other materials, such as metal can be used.

Figure 6:
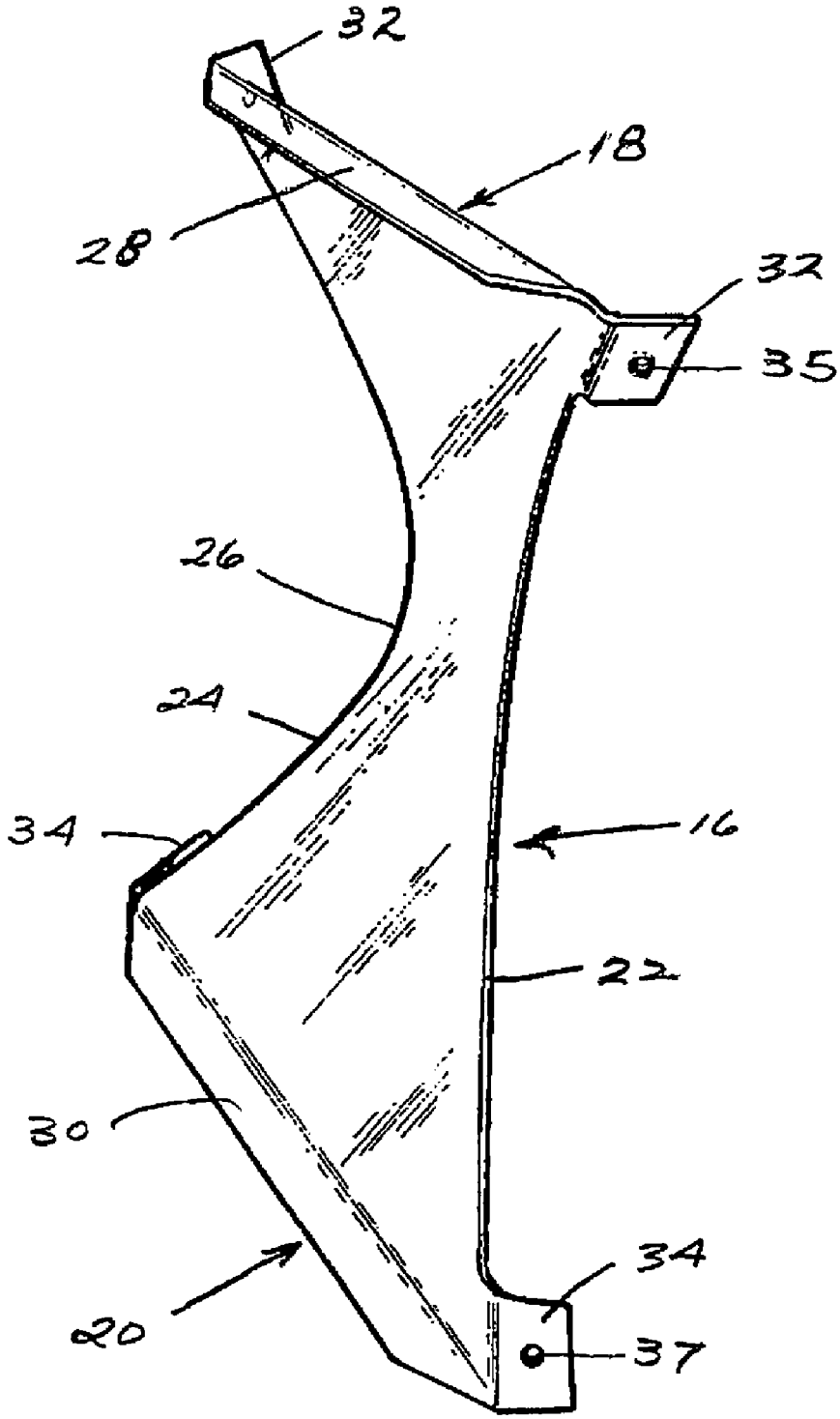
FIG. 6 is a perspective view of one of the side panels of the present invention.

As shown in FIG. 6, each side panel 16 has a relatively wide upper end 18 and relatively wide lower end 20, with side edges 22 and 24 tapering inwardly from the upper and lower ends to a relatively narrow neck 26 in the panel. The upper end of the panel 18 has an outwardly extending flange 28 along an upper edge. The lower end of the panel 20 has an outwardly extending flange 30 along the lower edge. Attachment tabs 32 and 34 extend outwardly from the side edges of the upper and lower ends of the panel, respectively, for the purpose of attaching the panels together. Tabs 32 and 34 desirably are formed at an angle of about 60 degrees from the plane of the panel so that the tabs of adjacent panels will mate.

Figure 7:
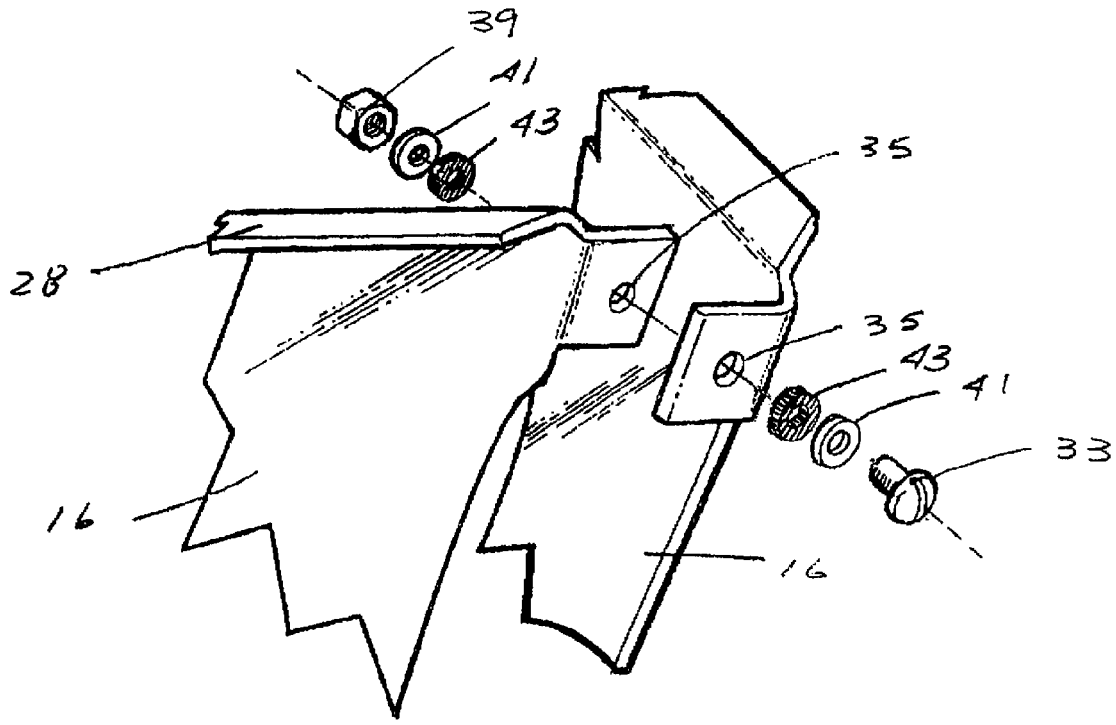
FIG. 7 is a fragmentary view of a corner of the ball stacking device of FIGS. 1-6, showing the manner in which corners are attached together.

The panels desirably are connected together by threaded fasteners. In the embodiment of FIGS. 1-7, a single fastener is used at each corner. In this embodiment, as shown in FIG. 7, screws 33 extend through a pair of mating openings 35 and 37 in overlapping upper and lower tabs 32 and 34. Nuts 39 and washers 41 and 43 fit on the fasteners to secure the panels together. Washers 41 may be flat metal washers or spring washers. Washers 43 desirably are resilient washers formed of rubber or the like. Rubber washers 43 engage the plastic panels and cushion the tabs and protect them from being cracked by tightening the nuts. Other types of fasteners and washers can be used. Sealing washers, which are washers having rubber washers bonded to them, are preferred. These are described below.

Figure 8:
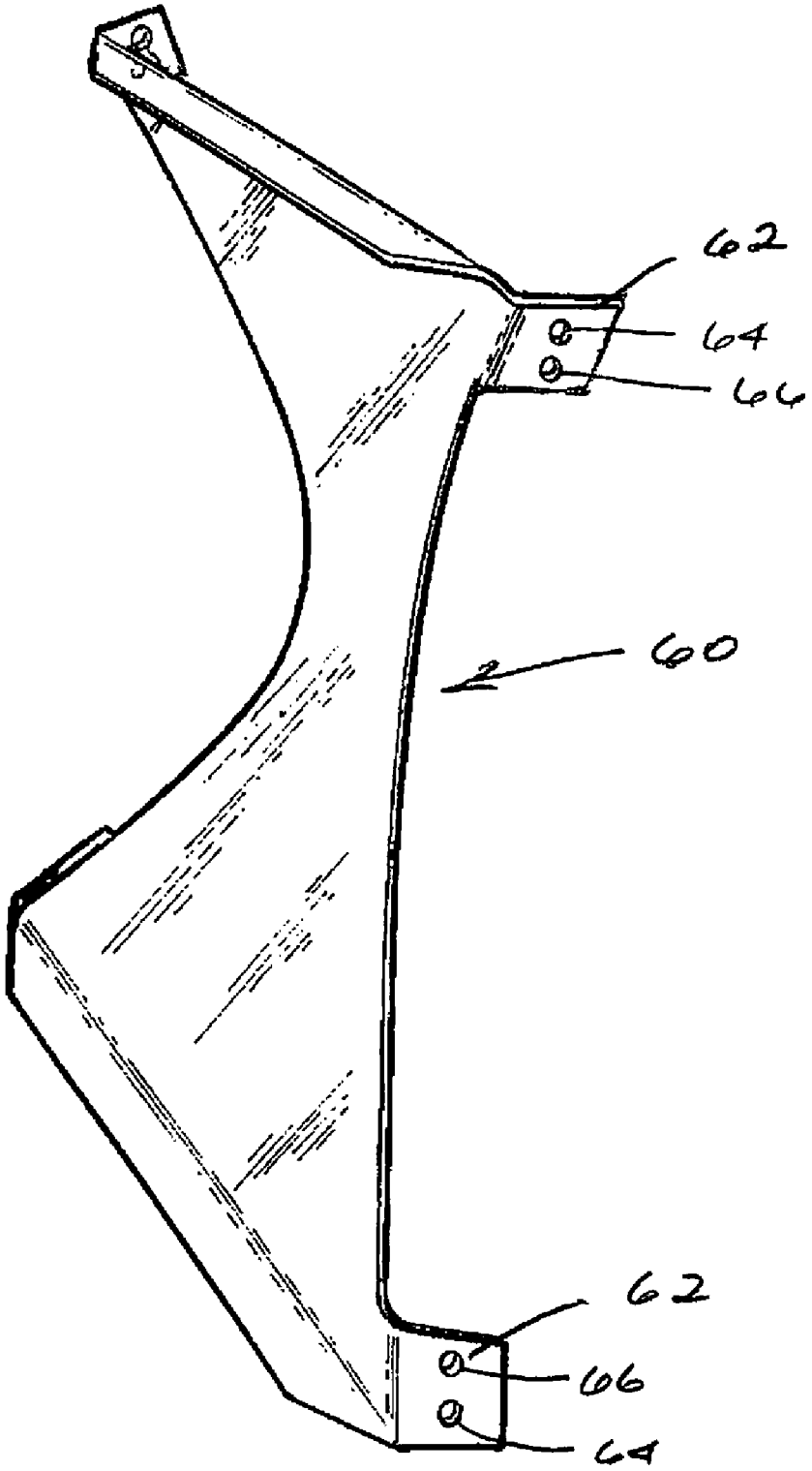
FIG. 8 is a perspective view of a second and preferred embodiment of one of the side panels of the present invention.
Figure 9:
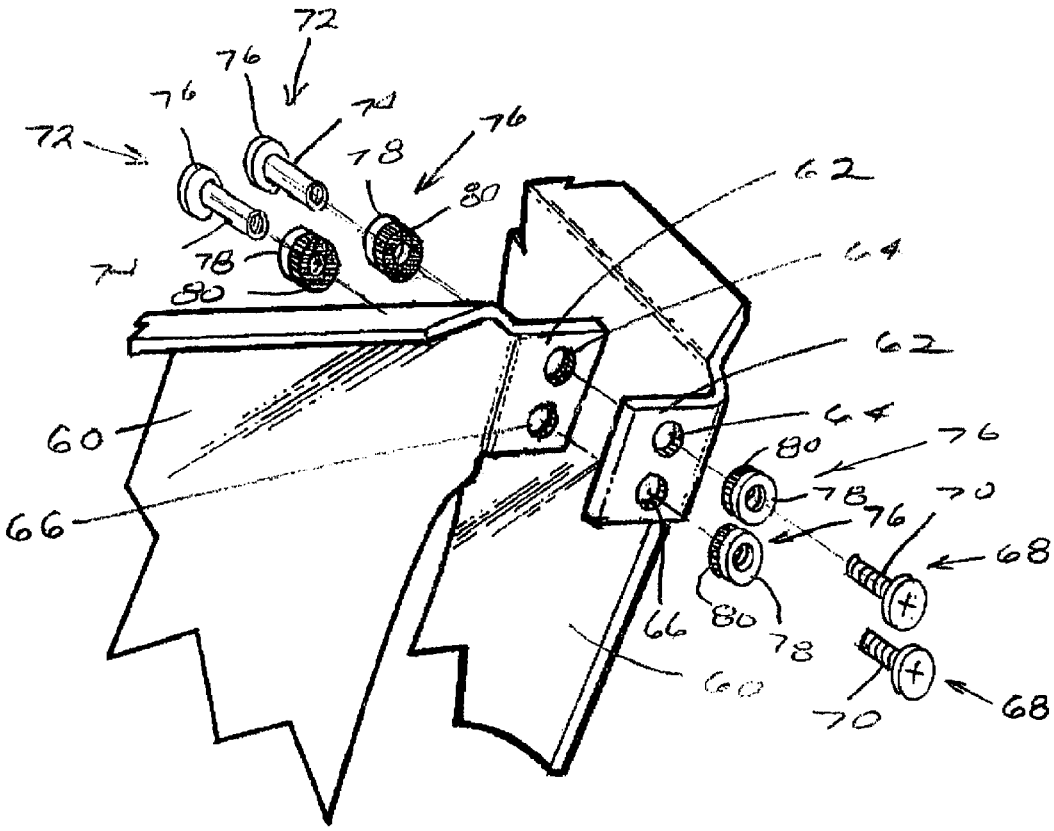
FIG. 9 is a fragmentary view of a corner of the ball stacking device of FIG. 8 showing the manner in which the corners are attached together.

In another and preferred embodiment of the present invention, shown in FIGS. 8 and 9, panels 60 (which are otherwise like panels 16), include attachment tabs 62 at each corner that each have two fastener openings 64 and 66. Threaded fasteners 68 fit through the fastener openings and attach the tabs together. Fasteners 68 desirably are screws 70 that screw into T-nuts 72. T-nuts 72 are conventional and include an internally threaded tube 74 that is open at one end and includes an enlarged head 76 at the other end. Tube 74 fits in opening 64 or 66, and screw 70 screws into the open end. The T-nut type fastener with internally threaded tube helps to prevent damage to the panels by shielding the plastic panels from the screw threads and avoiding excessive pressure on the panels as the screw is tightened against the tube. Sealing washers 77, comprising conical metal washers 78 with rubber cushioning washers or seals 80 fused to an inner side thereof, are positioned between the heads of the fasteners and the plastic tabs of the side panels in order to cushion the plastic tabs from cracking on tightening. An extra layer of plastic can be employed at the tabs to provide reinforcement. The use of two fasteners at each corner helps to maintain proper alignment of the respective panels with respect to each other when they are connected and prevents the panels from twisting out of proper position at the corners.

Figure 2:
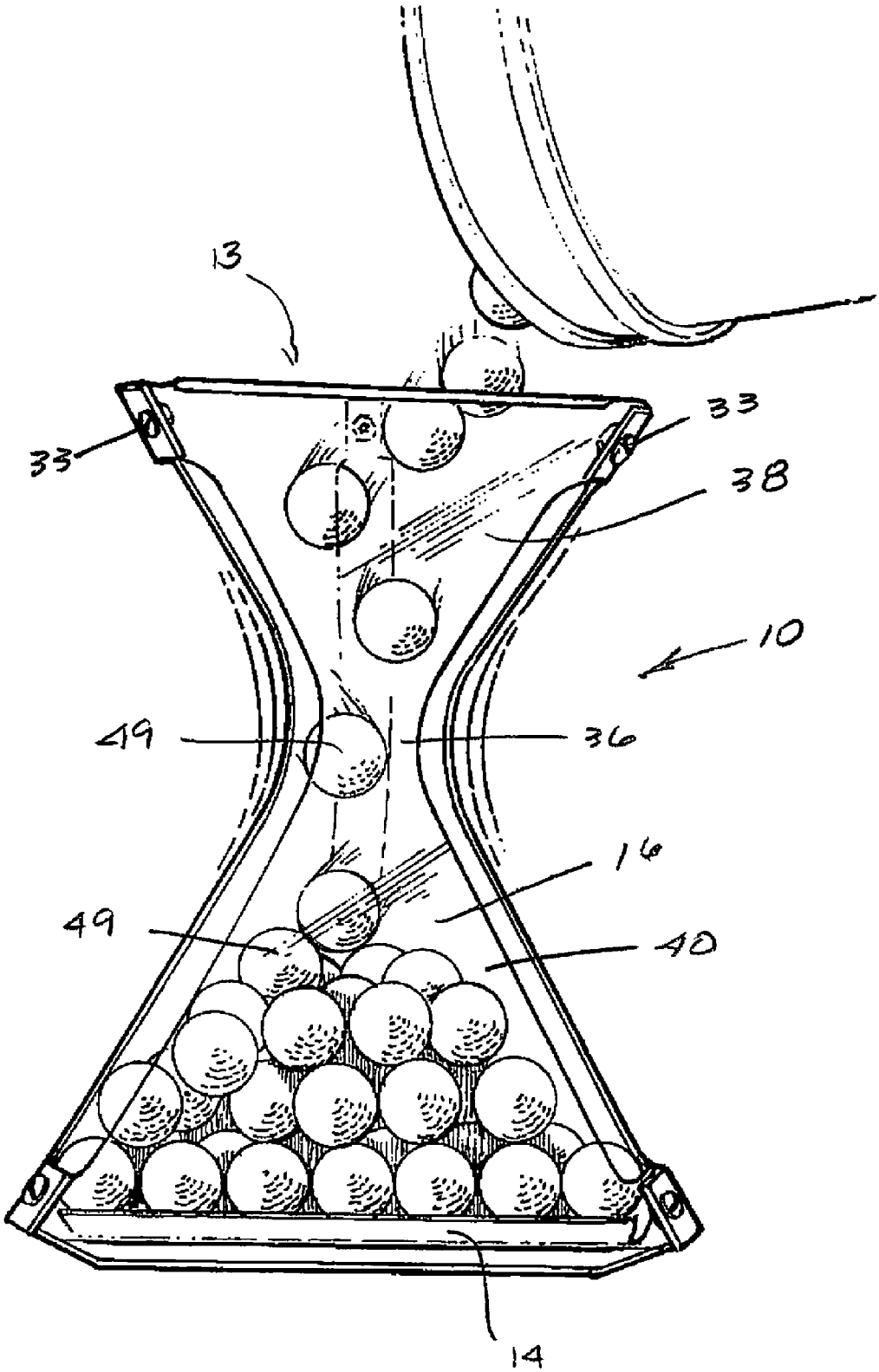
FIG. 2 is a side elevational view showing the golf ball stacking device of the present invention in the process of being filled with golf balls.

The panels are formed in an arcuate shape so that the neck portions of the panels curve inwardly to form a relatively narrow throat 36 between an enlarged chamber in the upper portion 38 of the body and an enlarged stacking chamber in a lower portion 40 of the body. The panels are formed in an arc having a radius of about eight inches at the throat in the preferred embodiment shown. The radius could be larger or smaller. A desirable range is 7½ to 8½ inches in radius. The upper portion 38 serves as hopper or a funnel for receiving golf balls into the ball stacking device, as shown in FIG. 2.

Figure 3:
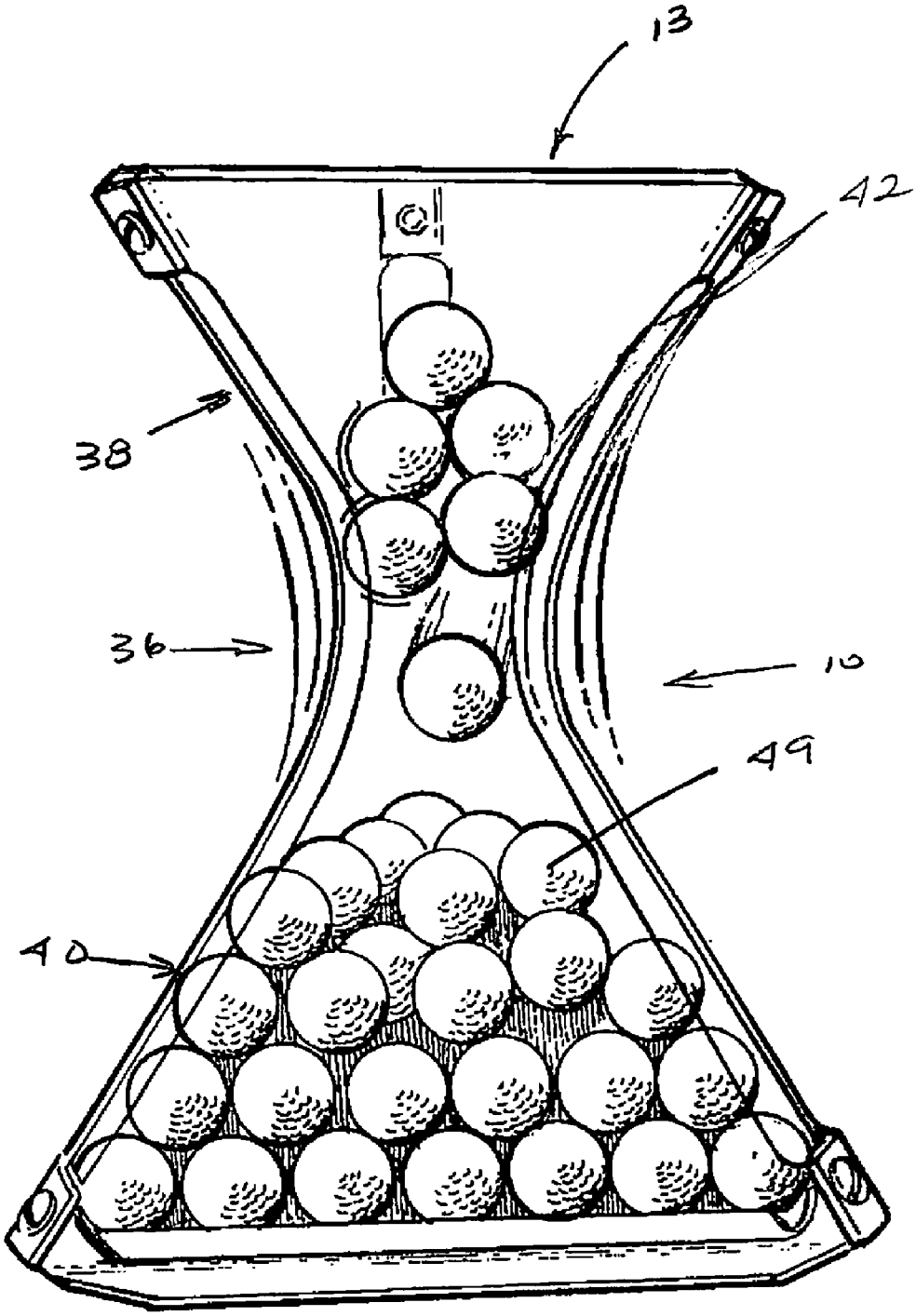
FIG. 3 is a side elevational view similar to FIG. 2 showing the manner in which the flexibility of the sides of the device surrounding the throat permits the sides to flex outwardly to prevent the balls from clogging in the throat.

A desirable feature of the present invention is that the side panels of the device are not only arcuate but are flexible and are not rigidly held in position in the area of the throat. The arcuate shape of the throat provides a gradually tapering, smooth surface that facilitates ball movement through the throat, while the flexible and unrestricted walls of the throat make it possible for the walls to flex outwardly as necessary in order to permit balls to slide through the throat when too many balls are poured into the funnel. The flexing of the throat is illustrated in FIGS. 2 and 3.

The diameter of the throat should be large enough so that the balls flow smoothly through the throat and stack evenly on the tray, with the last ball centered on the top. Desirably, the throat diameter in its unflexed position is at least slightly larger than the diameter of the balls. The diameter of a golf ball is about 1.68 inches, so the unflexed throat diameter (or the circle that is circumscribed by the sides of the panels at the neck) should be somewhat larger. A diameter of about two inches or so is satisfactory, but a smaller diameter slightly greater than the ball diameter or a somewhat larger diameter is usable. The optimum size will depend on the configuration of the stacking device and the materials and thickness of materials employed in the panels.

The maximum throat diameter is selected to maintain the above flow characteristics. Depending on the flexibility of the panels, a throat diameter of up to about one and one-half the diameter of a golf ball is satisfactory for this purpose, although a larger opening (but less than two ball diameters in any case) could be employed. In any case, the throat opening between the panels should be small enough and centered over the apex of the ball pyramid so that the balls stack properly on the tray and the last ball is properly positioned on the top.

The materials and panel curvature are selected so that the sides flex outwardly sufficiently to minimize clogging while still controlling the flow of the balls sufficiently to maintain the desired pyramidal shape of the stack. Any significant flexibility, such as flexibility sufficient to produce a 1/16 inches to 3/16 inches increase in the throat diameter, will reduce clogging significantly.

As shown in FIG. 3, the intermediate portions of the side edges of the panels are spaced apart so as to form longitudinal slots 42 between the adjacent edges of the side panels. Slots 42 are useful in order to enable a person to rearrange balls 49 in the lower portion or eliminate clogs in the upper portion (although the flexible sidewalls minimize clogs in the upper portion). A user may simply insert his finger 45 or other implement through the slot and move the balls around as desired.

Figure 4:
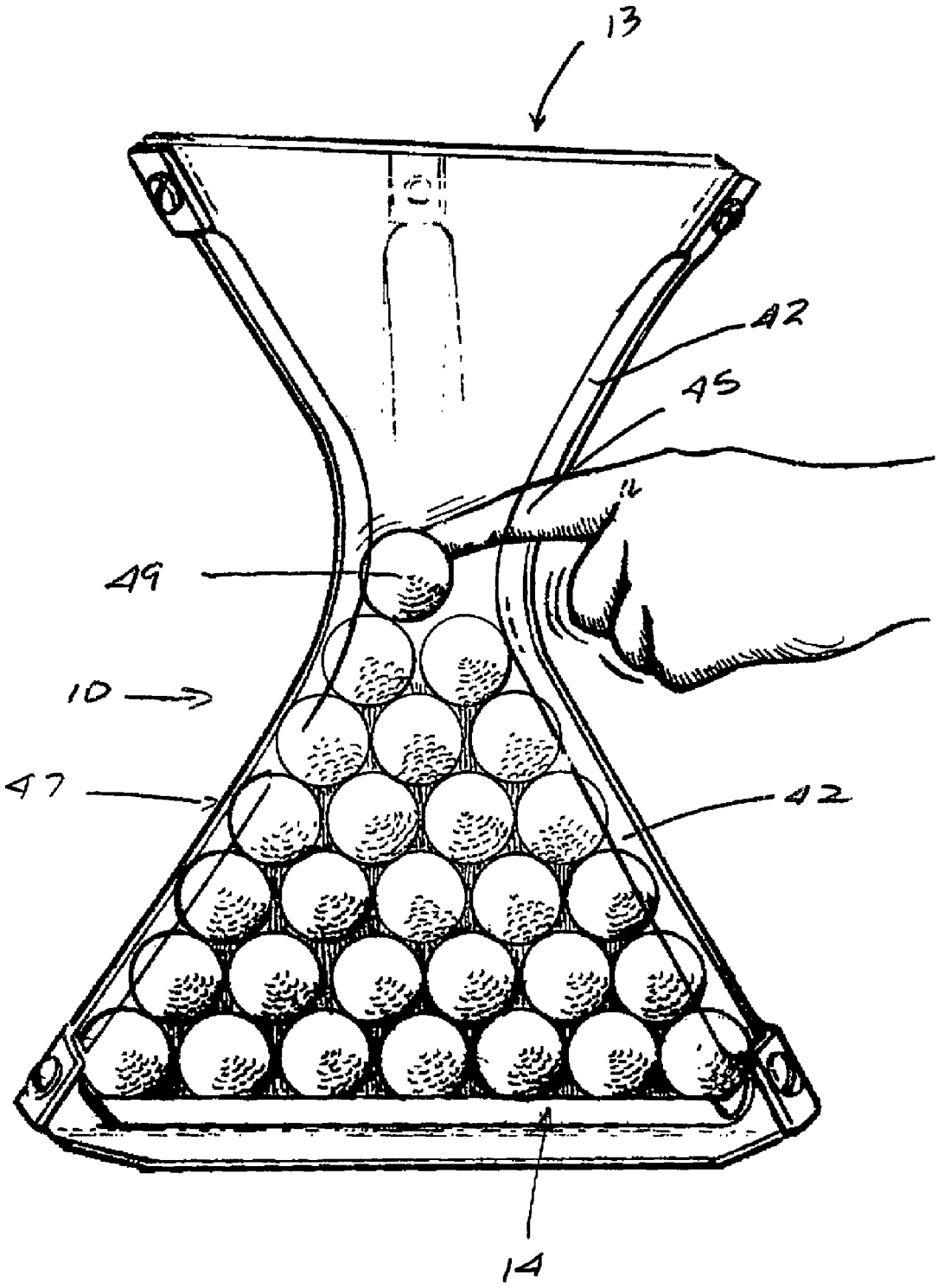
FIG. 4 is a side elevational view showing how the slots in the edges of the device permit adjustment of ball position in the interior of the stacking chamber.
Figure 5:
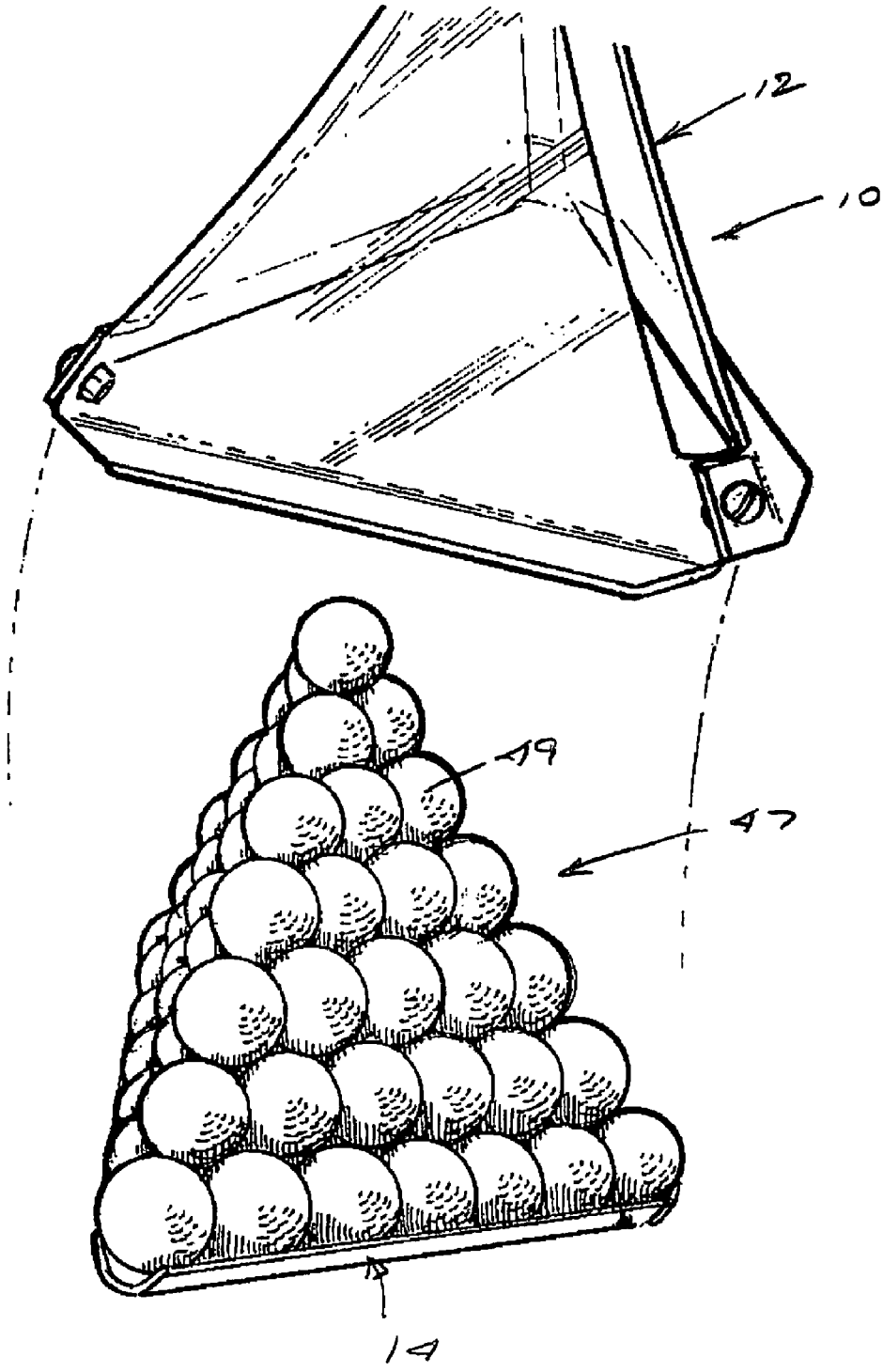
FIG. 5 is a pictorial view showing the stacking device being removed from a stack of balls on the ball stacking tray.

As shown in FIG. 4, when the balls fall into the lower portion or stacking chamber 40 they are formed into a stack on triangular stacking tray 14 in the shape of a pyramid 47. The triangular base of the pyramid provides an important advantage in the present invention because a triangular base places the balls in their closest proximity to each other and does not require depressions or ridges on the ball supporting surface of the tray in order to position the balls for stacking, as in some prior devices. Instead, the ball supporting surface of the tray can be smooth, letting the balls orient themselves as they fall into the tray. The balls thus find their own proper position on the tray. Tray 14 has upwardly extending side edges 46 that keep the balls on the tray, but otherwise the tray is simply a sheet of plastic with upturned edges having a flat, central ball supporting surface 44 inside of the upturned edges 46. Thus, the tray can be inexpensively constructed, while at the same time providing improved ball orienting characteristics.

While the invention as shown is particularly suitable for stacking golf balls, the invention also could be employed for stacking other types of balls wherein a stacked triangular presentation would be desirable.

It should be understood that the foregoing is merely exemplary of the preferred practice of the present invention and that various changes may be made in the arrangements and details of construction of the embodiments disclosed herein without departing from the spirit and scope of the present invention, as defined in the appended claims.

What is claimed is:

1. A golf ball stacking device comprising:

an elongated body having sidewalls and an open top and open bottom, the body sidewalls comprising three panels formed of a resilient and flexible sheet material and connected together so as to form a hollow body having a generally triangular cross section, each panel having relatively wide upper and lower ends and inwardly tapered sides leading to a relatively narrow neck portion positioned between the ends, the panels being connected together only at the upper and lower ends in a triangular configuration, the neck portions of the panels extending arcuately inwardly so as to form a relatively narrow throat between relatively wide upper and lower portions of the body, the throat being of a size sufficient to permit a golf ball to pass therethrough, with side edges of the panels adjacent the neck portions of the panels not being rigidly connected together and having slots therebetween, such that the panels surrounding the throat can flex outwardly to provide a flexibly enlargeable throat opening for preventing ball clogging in the throat, the body upper and lower portions comprising upper and lower chambers having open upper and lower ends, the upper chamber comprising an inlet for receiving golf balls, golf balls thereafter falling through the throat into the lower chamber, the lower chamber comprising a stacking chamber for forming the golf balls into a triangular pyramid; and a removable tray that fits under the lower end of the body, the tray having a ball engaging surface and raised ball supporting ridges formed in a triangular configuration around the ball supporting surface, the ridges being formed and positioned to urge a bottom layer of golf balls to form a triangular configuration on the tray so as to support a triangular pyramidal stack of balls on the tray.

2. A golf ball stacking device comprising:

an elongated body having sidewalls and an open top and open bottom, the body sidewalls comprising three panels formed of flexible sheet material and connected together so as to form a hollow body having a generally triangular cross section, each panel having relatively wide upper and lower ends and inwardly tapered side edges forming a relatively narrow neck portion positioned between the upper and lower ends, the panels being connected together only at the upper and lower ends, wherein the side edges of adjacent panels are spaced apart to form a slot between the side edges of said adjacent panels, the slots being sufficiently wide such that an operator can insert a finger or other projection through at least one of the slots to adjust the positions of balls and facilitate ball movement and positioning in the interior of the body, the neck portions of the panels forming a relatively narrow throat between relatively wide upper and lower portions of the body, the throat being of a size sufficient to permit a golf ball to pass therethrough, the body upper and lower portions comprising upper and lower chambers having open upper and lower ends, the upper chamber comprising an inlet for receiving golf balls, golf balls thereafter falling through the throat into the lower chamber, the lower chamber comprising a stacking chamber for forming the golf balls into a triangular pyramid; and a removable tray that fits under the lower end of the body, the tray having a ball engaging surface and raised ball supporting ridges formed in a triangular configuration around the ball supporting surface, the ridges being formed and positioned to urge a bottom layer of golf balls to form a triangular configuration on the tray so as to support a triangular pyramidal stack of balls on the tray.

3. A golf ball stacking device as in claim 2 wherein the neck portions of the panels extend arcuately inwardly such that they form an arcuate throat when the panels are interconnected.

4. A golf ball stacking device as in claim 3 wherein the panels are attached together by fasteners that extend through openings in overlapping panel surfaces at the corners.

5. A golf ball stacking device as in claim 4 wherein the panels include tabs at the corners that have openings therein that overlap openings in tabs in adjacent panel corners when the panels are assembled together, the panels being held together by releasable fasteners.

6. A golf ball stacking device as in claim 5 wherein the tabs at each corner are attached together by two fasteners that maintain the panels in a fixed position with respect to each other.

7. A golf ball stacking device as in claim 1 wherein the panels comprise a transparent sheet plastic material.

8. A golf ball stacking device as in claim 1 wherein the panels have an arcuate radius of 7½ to 8½ inches at the throat.

9. A golf ball stacking device as in claim 1 wherein the panels are formed of a synthetic resin sheet material that is thin enough and flexible enough to permit balls to pass through the throat without substantial clogging.

10. A golf ball stacking device as in claim 1 wherein the side panels comprise a flexible, resilient synthetic resin.

11. A golf ball stacking device as in claim 10 wherein the side panels comprise at least one of polyethylene and polyester.

12. A golf ball stacking device as in claim 11 wherein the panels are about 2/32 to 3/16 inches thick at the throat.

13. A golf ball stacking device as in claim 1 wherein the panels are 3/32-4/32 inches thick at the throat.

14. A golf ball stacking device as in claim 1 wherein the side panels are sufficiently flexible that they can resiliently flex outwardly at the throat as a result of balls passing through the device by at least 1/16 of an inch.

15. A golf ball stacking device as in claim 14 wherein the side panels can resiliently flex outwardly by a distance of about 1/16 to about 3/16 of an inch at the throat.

16. A golf ball stacking device as in claim 3 wherein the panels are formed of a synthetic resin comprising one or more of polyethylene and polyester, the panel thicknesses are about 2/32-3/16 inches thick, and the radius of the arc of panels at the throat is about 7½ to 8½ inches.

17. A golf ball stacking device as in claim 1 wherein the removable tray has a generally flat ball engaging surface without dimples, such that balls located thereon can roll freely to self-position themselves in a triangular configuration on the tray.

18. A golf ball stacking device as in claim 17 wherein the removable tray is formed of a synthetic resin and comprises a triangular base having upturned side edges that frame the ridges on the tray, the ridge fitting inside the open lower end of the lower chamber.

19. A golf ball stacking device as in claim 1 wherein the slots are formed such that an operator can insert a finger or other projection through at least one of the slots to adjust the positions of balls and facilitate ball movement and positioning in the interior of the body.

* * * * *